United States Patent [19]

DuBois

[11] Patent Number: 4,645,550

[45] Date of Patent: Feb. 24, 1987

[54] PROCESS FOR TREATING GLASS CONTAINERS FOR HEAT SEALING

[76] Inventor: Jean G. DuBois, "en Bagatelle", 71700-Tournus, France

[21] Appl. No.: 716,342

[22] Filed: Mar. 27, 1985

[51] Int. Cl.[4] ..... B65B 7/00

[52] U.S. Cl. ..... 156/69; 427/208.2; 427/314; 427/386; 427/389.7; 427/389.8

[58] Field of Search ..... 427/208.2, 314, 389.7, 427/389.8, 386; 156/69; 428/35

[56] References Cited

U.S. PATENT DOCUMENTS

| | | | |
|---|---|---|---|
| 4,098,934 | 7/1978 | Brockway et al. | 428/35 |
| 4,264,656 | 4/1981 | Reeder | 427/389.7 X |
| 4,324,601 | 4/1982 | Dembicki et al. | 427/389.7 X |
| 4,442,129 | 4/1984 | Niwa et al. | 428/35 X |
| 4,478,667 | 10/1984 | Fitko | 156/307.3 |

FOREIGN PATENT DOCUMENTS 2130574 6/1984 United Kingdom .

*Primary Examiner*—Thurman K. Page
*Attorney, Agent, or Firm*—Marshall, O'Toole, Gerstein, Murray & Bicknell

[57] ABSTRACT

Process for heat sealing glass containers. There is applied at least to the rim of a glass container adapted for receiving a sealing foil, at a temperature of 70°-150° C., a composition containing a mixture of at least one acrylic resin and at least one aminoplast resin in an aqueous medium. After drying, there is applied on the rim a sealing foil coated with a varnish or a plastic film by means of a heating head for a time and at a temperature sufficient to fix and seal the foil to the container.

14 Claims, No Drawings

PROCESS FOR TREATING GLASS CONTAINERS FOR HEAT SEALING

The present invention relates to a process for treating glass containers such as jars or bottles preparatory to heat sealing them.

Glass containers such as jars or bottles are sealed by means of either screw caps or notched caps, which are very costly sealing devices.

In addition, heat sealing by means of coated aluminum foil is known. Heat sealing of untreated glass containers, however, frequently presents problems of adherence of the sealing foil. Furthermore, heat sealing of containers treated by conventional processes, i.e., treated hot by the so-called "hot end" treatment with tin derivatives or titanium derivatives followed by a so-called "cold end" treatment, does not provide sealing which remains reliable with time, because of, in particular, problems of adherence of the aluminum foil to the glass container.

Applicant has discovered a process for treating at least the rim of glass containers onto which the aluminum foil is to be applied to create the seal. As a result of this treatment, it is possible to achieve low-cost heat sealing which remains reliable with time.

Applicant has also discovered that, by applying this treatment to the whole container or at least to the external surface, it is possible to improve the resistance of the glass to scratching and breakage, and to increase the slip.

The method of the invention consists essentially of applying to the glass container a composition containing acrylic and aminoplast resins.

The treatment can be carried out either on untreated glass, in which case it improves the scratch-resistance, gives the required slip and facilitates heat sealing, or on glass treated while hot by conventional processes with tin or titanium in order to provide additional security, in which case it provides the required slip and improves the heat sealing qualities.

In accordance with the process of the invention, there is applied to a glass container, at least to the part intended for accepting a sealing device, at a temperature between 70° and 150° C., a composition containing a mixture of at least one acrylic resin and at least one aminoplast resin in a solvent medium. After the container is dried, heat sealing can be carried out by means of an aluminum foil coated with a conventional varnish or plastic film.

The aminoplast resins useful in the invention are well known thermosetting resins found by the reaction of an aldehyde, such as formaldehyde or acetaldehyde, with urea, ethyleneurea, melamine and other triazines, such as melamine in which one amino group is replaced by an alkyl or aryl group, e.g., benzoguanamine. Suitable aminoplast resins are those which are dispersible or soluble in aqueous media, and especially hexamethoxymethylmelamine and the reaction products of formaldehyde with melamine, alkyl and aryl carbamates, and urea. Examples of such resins are the commercial products DYNOMIN UM-15, a methylated urea formaldehyde resin having a viscosity of 9,500–21,000 cps at 20° C. and a specific gravity of 1, sold by Dyno Industries A.S., and PROX M-3-R, a methylated melamine formaldehyde resin containing 68% of dry matter, sold by Protex.

The acrylic resins used in the invention are thermoplastic or self-crosslinking thermosetting resins having the generic formula

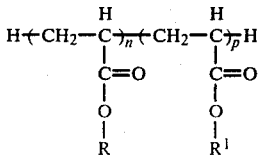

wherein R and $R^1$ are selected from $C_1$–$C_{12}$ alkyl groups for thermoplastic resins; for thermosetting resins, R is selected from $C_4$–$C_{12}$ alkyl groups, $R^1$ is selected from $—NHCH_2OH$ and $—N(CH_2OH)_2$; and p and n are integers, and for thermosetting resins, $$\frac{p}{n+p} \leqq 0.25.$$

The aminoplast and acrylic resins, which have molecular weights between 500 and 3,000,000 are present in the compositions according to the invention in proportions between 0.15 and 20% by weight, expressed as active material, and preferably between 1 and 10% by weight. The weight ratio of acrylic to aminoplast resin in the compositions is suitably between about 5.67:1 and 19:1.

According to a preferred embodiment, the aminoplast and acrylic resins are associated with polyurethane resins. According to another embodiment, the aminoplast and acrylic resins are associated with polyester and epoxy resins.

The additional polyurethane, polyester, or epoxy resins can be present in proportions which are sometimes greater than those of the aminoplast or acrylic resins. The proportions of additional resin are preferably between 30 and 80% by weight relative to the total weight of the resins present.

The solvent medium used in the compositions according to the invention can consist of water or a mixture of water and an organic solvent chosen from alcohols, glycols and amines.

The compositions of the invention can, in particular, take the form of solutions such as aqueous or hydroalcoholic solutions, and can contain amines chosen from alkylamines or alkanolamines such as, for example, diethylamine or triethanolamine. The compositions according to the invention can also, depending on the nature of the resins used, take the form of emulsions or of colloidal solutions based on the solvents mentioned above.

In the case of the emulsions, alkyl ethers of diethylene glycol such as diethylene glycol monobutyl ether, are preferably used as solvents. This type of solvent can be used in proportions ranging up to 30% and enables a clear, transparent film to be obtained on the glass containers, when an emulsion is used.

The compositions used in the process according to the invention can also contain silicones or zirconium derivatives, as well as other adjuvants such as waxes, surfactants and polyols which are themselves soluble or dispersible in water and which can also improve further the slip and scratch properties.

The silicones are preferably polymethylsiloxanes or polymethylphenylsiloxanes having molecular weights of about 2,000, and can be used in proportions ranging up to 5% by weight of the dry matter in the composition.

The zirconium derivatives are preferably salts of carboxylic acids, such as zirconium propionate, zirconium ammonium carbonate, zirconium stearate, and zirconium methacrylate, and are used as adhesive promoting agents. Suitable products are those sold under the name BACOTE by Magnesium Elektron, Ltd.

According to the process of the invention, the compositions defined above are applied to glass containers on the production lines as they emerge from the furnace at a temperature of 70°-150° C. The application can be carried out by spraying with a pneumatic spraygun, or electrostatically without air, or otherwise.

The film is applied in such a way as to cover at least the rim of the glass container, the rim being intended for accepting the sealing means, and preferably in such a way as to cover the external surface of the glass container with a continuous film. The film has a thickness which can vary according to the desired result, and is preferably between 0.5 and 5 microns in thickness.

There are thereby obtained for the coated glass containers a very good slip capacity and an improved resistance to scratching, pasteurization, storage in an especially active medium and rinsing with hot caustic soda solutions. In addition, the coating discourages mold growth.

The heat sealing is carried out by applying an aluminum foil having a heat-seal varnish coating or a suitable plastic film such as, more especially, a polyester film, e.g., Surlyn film sold by DuPont de Nemours. There can also be used for heat sealing, among others, coated aluminum foils sold under the name Gekalid by Nyffeler Corti A. G., or Aluthene sold by Societe Alsacienne d'Aluminium.

The coated aluminum foil is applied to the container to be sealed by means of a heating head for a few seconds, preferably 1 to 2 seconds, at a temperature sufficient to fix the foil to the container. This temperature is between 100° and 300° C. depending on the nature of the coating on the aluminum foil.

In this manner, there is obtained a heat sealing which has a peel strength on the order of 3 kg/cm$^2$ or more.

The compositions used in the process according to the invention can be prepared in two forms, either in the form of a single pack, or in the form of a two-component pack.

When the composition used according to the invention is prepared in the form of a two-component pack, the first component consists of a solution or emulsion containing the resins and adjuvants, and the second constituent contains a polymerization catalyst. The two components can be mixed just before use, according to a predetermined quantity by volume or by weight. The mixing can also be carried out directly in the head of a spraygun using a dual inlet system, in a suitable volume ratio.

The catalysts used with a two-component pack are known per se and, depending on the polymerization speed and property sought, are selected from organic acids such as butylphosphoric acid, para-toluenesulfonic acid, benzenesulfonic acid, paraphenolsulfonic acid and other acids having a sulfonic or sulfuric group, and inorganic acids, such as sulfuric, phosphoric or aziridine acids, to which acids there can optionally be added water or a mixture of water and an organic solvent as mentioned above.

In the case where the product is used in the form of a single-component pack, the catalysts are used, as is well known, in the form of an organic salt which is added to the composition at the time of manufacture. Catalysis will in this case be effective at the time of application, and it will naturally be possible to add any other product such as metal salts which accelerate the catalysis.

The catalysts are added in catalytically effective proportions which are preferably between 0.1 and 5% by weight relative to the total weight of the composition. Among other compounds, there can be used aziridine compounds in proportions from 0.2 to 1.5% by weight.

It is observed that glass containers treated according to the invention possess in addition the advantage that they do not cause pollution problems. In fact, the treatment is no obstacle to recycling the glass, since the resins used are completely destroyed at high temperatures and are removed in the form of $CO_2$, $H_2O$ and NO gases.

The examples which follow are intended to illustrate the invention without being in any way restrictive in nature.

EXAMPLE I

The following composition is prepared:

| | Wt. % |
|---|---|
| Acrylic ACRYMUL AM-185-RS (Protex) | 6.0 |
| Modified melamine sold under the name PROX M-3-R (Protex) | 0.46 |
| Polyethylene wax EN-62 (Polychimie) | 0.6 |
| Silicone SILANE A-1100 (Union Carbide) | 0.4 |
| Water/diethylene glycol monobutyl ether (7/30) q.s. | 100.0 |

After application of the composition to heated glass containers, heat sealing is carried out with an aluminum foil sold under the name Gekalid by Nyffeler Corti AG., the aluminum foil being applied by means of a heating head at a temperature of 150° C. After the container is cooled, it is observed that the heat seal has good strength and is well preserved over a period of time.

EXAMPLE II

The procedure of Example I is repeated with the following materials:

| | Parts by Weight |
|---|---|
| PART A | |
| ACRYMUL 185-RS - (Protex) | 9.0 |
| PROX M-3-R - 68% dry matter | 0.7 |
| EN-62 WAX - 20% dry matter (Polychimie) | 1.0 |
| BACOTE-20 (Magnesium Elektron Ltd.) | 0.3 |
| Water/diethylene glycol monobutyl ether (70/30) | 89.0 |
| | 100.00 |
| PART B | |
| Aziridine catalyst such as NEOCRYL CX-100 (Polyvinyl Chemie) | 1.0 |
| Water | 100.0 |
| | 101.0 |

A composition made by adding part A to part B is applied to glass containers. After heat sealing as described in Example I, a seal is obtained which has good properties. By this means, it is possible reliably to preserve, among other things, various foodstuffs.

The trade names used in the above examples designate, in particular, the following products:

DYNOMIN UM-15: methylated urea formldehyde resin having a viscosity of 9,500 to 21,000 cps at 20° C. and a specific gravity of 1, sold by Dyno Industries A.S.

ACRYMUL AM-185-RS: emulsion of an acrylic resin containing 50% of dry matter, of viscosity less than 100 cps at 20° C. and of specific gravity of 1.

PROX M-3-R: methylated melamine formaldehyde resin containing 68% of dry matter.

WAX EN-62: polyethylene wax emulsion, of molecular weight =2100.

SILANE A-1100: aminopropyltriethoxysilane, manufactured and marketed by Union Carbide.

BACOTE-20 zirconium ammonium carbonate.

The foregoing detailed description has been given for clearness of understanding only and no unnecessary limitations should be understood therefrom as modifications will be obvious to those skilled in the art.

What is claimed is:

1. A method of treating a glass container having a rim of improving the adherence of a metallic foil heat seal comprising the steps of:

applying at least to said rim at a temperature of 70°-150° C. a film of an aqueous composition containing at least one acrylic resin, at least one aminoplast resin, and a polymerization cataylst chosen from inorganic acids and organic acids, and drying said film.

2. A method in accordance with claim 1 wherein said aminoplast resin is selected from urea/formaldehyde, melamine/formaldehyde, hexamethoxymethylmelamine and carbamide resins.

3. A method in accordance with claim 1 wherein said composition contains in addition at least one polyurethane resin.

4. A method in accordance with claim 1 wherein said composition contains in addition an epoxy resin or a polyester resin which is dispersible or soluble in water.

5. A method in accordance with claim 1 wherein said composition contains in addition at least one silicone.

6. A method in accordance with claim 1 wherein said composition is a solution, an emulsion or a colloidal suspension.

7. A process in accordance with claim 1 wherein said composition contains in addition an alcohol, a polyol, or an amine.

8. A method in accordance with claim 1 wherein said composition contains in addition at least one alkyl ether of diethyleneglycol.

9. A method in accordance with claim 1 wherein said polymerization catalyst is chosen from aziridine acids.

10. A method in accordance with claim 9 wherein said inorganic acid is selected from phosphoric or sulfuric acids and said organic acid is selected from butylphosphoric, para-toluenesulfonic, benzenesulfonic, and para-phenolsulfonic acids.

11. A method in accordance with claim 1 in which said composition contains a total of 1-10% by weight of said resins, the weight ratio of acrylic to aminoplast resin therein being between about 5.67:1 and 19:1.

12. A method in accordance with claim 1 wherein said composition contains in addition up to about 30% by weight of diethyleneglycol alkyl ether.

13. A method of heat sealing a glass container having a rim comprising the steps of:

treating the rim of said container in accordance with the method of claim 1;

applying to said treated rim a plastic- or varnish-coated metallic foil heat seal, and sealing said heat seal to said rim.

14. A method in accordance with claim 13 wherein said heat seal is formed of aluminum and said seal is made by means of a heated head at a temperature of 100°-300° C. for a time of 1-2 seconds.

* * * * *